United States Patent [19]

Nakayasu et al.

[11] 4,208,180

[45] Jun. 17, 1980

[54] MIXED-FIRING BURNERS FOR USE WITH PULVERIZED COAL AND HEAVY OIL

[75] Inventors: Michiharu Nakayasu; Kenzo Kumamoto; Kenji Suzuki; Arata Kuba; Katsushi Kitagawa, all of Ube, Japan

[73] Assignee: Ube Industries, Ltd., Ube, Japan

[21] Appl. No.: 875,402

[22] Filed: Feb. 6, 1978

[51] Int. Cl.[2] ..... F23Q 9/00

[52] U.S. Cl. ..... 431/284; 239/404; 239/406

[58] Field of Search ..... 431/284, 285, 8, 181–185, 431/182; 110/261, 262; 239/404, 405, 406

[56] References Cited

U.S. PATENT DOCUMENTS

| | | | |
|---|---|---|---|
| 2,366,463 | 1/1945 | Vroom et al. | 431/284 |
| 2,861,629 | 11/1958 | Dailey, Jr. | 431/185 |
| 3,042,105 | 7/1962 | Bitterlich | 431/185 |
| 3,115,851 | 12/1963 | Creely | 110/261 |
| 3,425,631 | 2/1969 | Hensley | 431/185 |
| 3,827,851 | 8/1974 | Walker | 431/284 |
| 3,989,443 | 11/1976 | Campbell | 431/285 |

*Primary Examiner*—Samuel Scott
*Assistant Examiner*—Wesley S. Ratliff, Jr.
*Attorney, Agent, or Firm*—Charles E. Pfund

[57] ABSTRACT

A heavy oil supply pipe, a protective pipe, an air supply pipe for burning heavy oil, a coal-air supply pipe, a coolant supply pipe and a protective caster are arranged concentrically in the order mentioned. A coal whirler and an air whirler are provided to inpart whirling motions to coal flame and heavy oil flame for thoroughly admixing them.

2 Claims, 11 Drawing Figures

MIXED-FIRING BURNERS FOR USE WITH PULVERIZED COAL AND HEAVY OIL

BACKGROUND OF THE INVENTION

This invention relates to a mixed-firing burner for use with pulverized coal (hereinafter simply referred to as coal) and heavy oil and utilized in a combustion furnace for use in cement kilns or boilers.

For the purpose of effectively using coal which is more abundantly available than petroleum, there have been used burners which employ exclusive firing with coal (combustion by coal itself) or mixed-firing with coal and heavy oil. In the former type burner, since the length of the flame is long, high combustion temperature can not be obtained with the result that it is difficult to obtain perfect combustion and the efficiency of heat utilization is low. In burners which employ exclusive firing with heavy oil (combustion by heavy oil itself), on the other hand, since the oil burns well and the length of the flame is short, it is possible to realize high combustion temperatures. For this reason, the defects of the burner for exclusive use with coal can be eliminated by firing or burning a mixture of coal and heavy oil.

According to the conventional method for the mixed firing, pulverized coal and heavy oil are blown into the burner through parallelly disposed discrete burners or a mixture in which pulverized coals are suspended in heavy oil is burned. However, where pulverized coal and heavy oil are blown into the furnace through separate burners, due to the difference in the combustion characteristics of the flames of coal and heavy oil, it is difficult to obtain satisfactory combustion state, and where pulverized coal is suspended in heavy oil, it is necessary to incorporate an additive for the purpose of improving dispersion of the pulverized coal and preventing prepicitation of the same, thus complicating the operation and increasing the cost of fuel.

SUMMARY OF THE INVENTION

Accordingly, it is an object of this invention to provide a burner having compact and rugged construction and being capable of efficiently effecting mixed-firing with heavy oil and pulverized coal.

Another object of this invention is to provide a novel burner capable of changing the ratio of heavy oil and pulverized coal to any desirable ratio thereby producing any desired heat quantity.

Still another object of this invention is to provide a burner for mixed-firing with pulverized coal and heavy oil in which deposition and dry distillation of the pulverized coal on the wall of the coal-air mixture supply pipe can be prevented.

In accordance with this invention these and further objects can be accomplished by providing a mixed-firing burner for use with coal and heavy oil comprising a heavy oil supply pipe having a burner tip at one end, a protective pipe surrounding the heavy oil supply pipe, a pipe for supplying air necessary to burn heavy oil and surrounding the protective pipe, the air supply pipe being provided with a guide tube in its front end, a perforated plate provided at the fore end of the air supply pipe for interconnecting the guide pipe and the air supply pipe, a coal-air supply pipe concentrically surrounding the air supply pipe for supplying a mixture of pulverized coal and air, a cooling medium supply pipe and a protective caster successively surrounding the coal-air supply pipe, an air whirler provided between the tips of the protective pipe and the guide pipe, and a coal whirler provided between the tips of the air supply pipe and the coal-air supply pipe.

BRIEF DESCRIPTION OF THE DRAWINGS

Further objects and advantages of the invention can be move fully understood from the following detailed description taken in conjunction with the accompanying drawings in which.

DESCRIPTION OF THE PREFERRED EMBODIMENT

Figure 1:
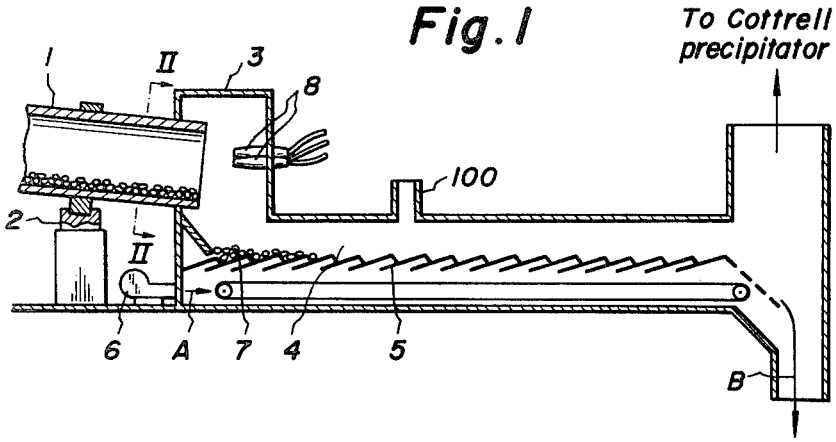
FIG. 1 is a sectional view showing the portions of the furnace near burners.
Figure 2:
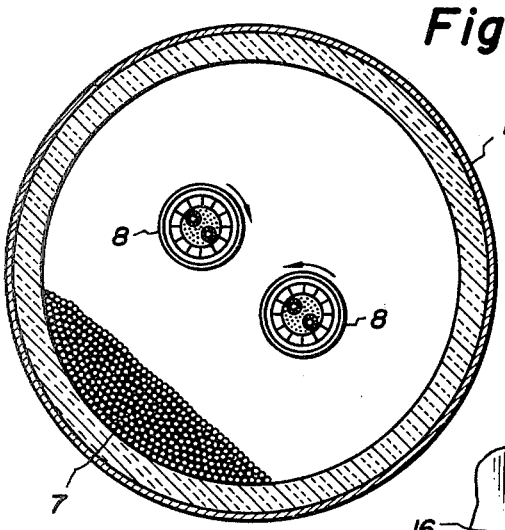
FIG. 2 is an enlarged cross-sectional view of the furnace shown in FIG. 1 taken along a line II—II.

FIGS. 1 and 2 show an application of this invention to a rotary kiln 1 for firing cement. The rotary kiln 1 is supported by rollers 2 and its one end is enclosed in a hood 3. A clinker cooler 4 overlain by a grate is housed in the lower portion of the hood 3 and a cooling fan 6 is connected to the bottom of the hood so as to pass cooling air injected as shown by an arrow A through the grate 5 and a layer 7 of fired cement on the grate. A portion of the heated air enters into the rotary kiln 1 and is drawn out of a port 100 to act as the secondary air while the remaining air is conveyed to a Cottrell precipitator, not shown. The secondary air from the port 100 is used to dry pulverized coals.

A plurality of grates comprised of the grate 5 are arranged to overlap with each other with a slight inclination as shown in FIG. 1. The gates, every other, reciprocate back and forth so that clinkers are conveyed from left to right and during this conveyance, clinkers of a small size slip off through the grate onto a conveyor and clinkers of a large size carried on the grate 5 are directly exposed to the cooling air, thereby being cooled efficiently. The large sized and small sized clinkers are finally delivered in the direction shown by an arrow B.

A burner 8 is mounted on the hood with its discharge end directed toward the kiln. As shown in FIG. 2, two burners 8 are provided which are offset from the axis of the kiln by taking into consideration their positions relative to the fired cement. However, the number of the burners is not limited to two.

Figure 3:
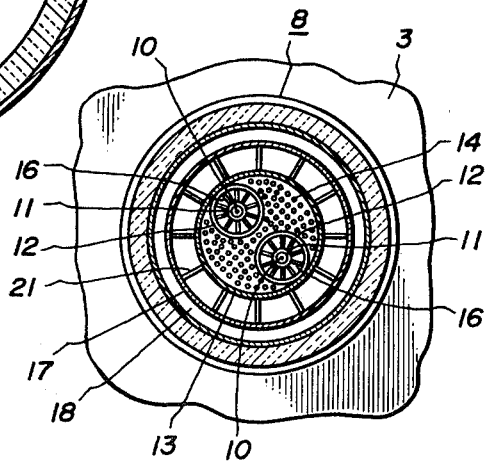
FIG. 3 is an enlarged cross-sectional view of one burner taken along a line III—III of FIG. 4.
Figure 4:
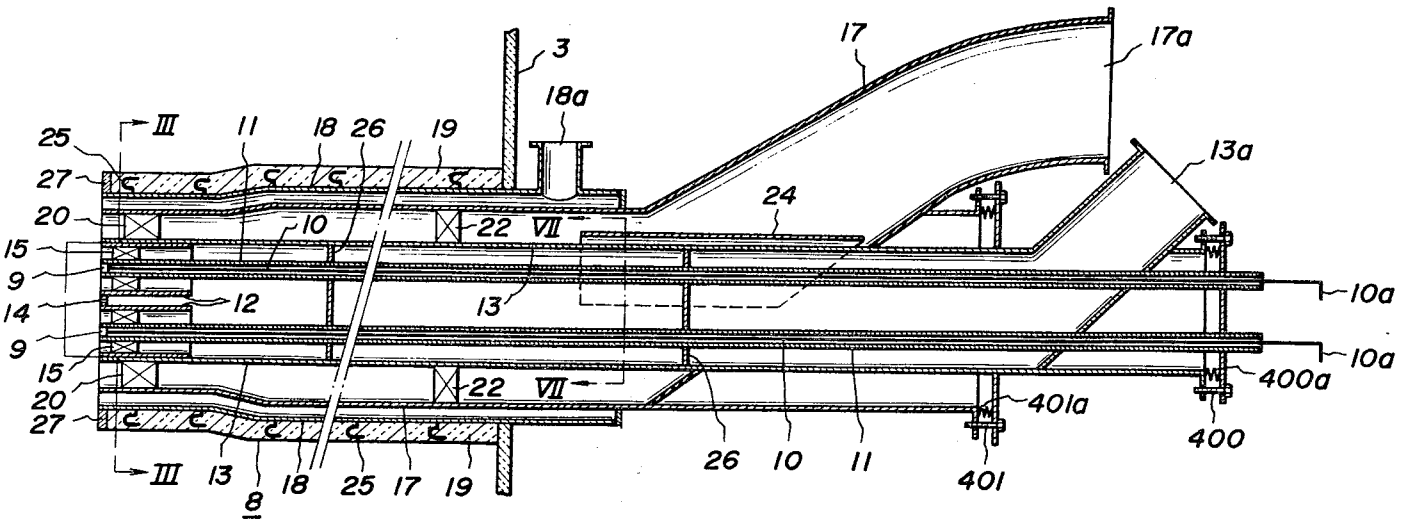
FIG. 4 is a longitudinal sectional view of the burner shown in FIG. 3.
Figure 8A:
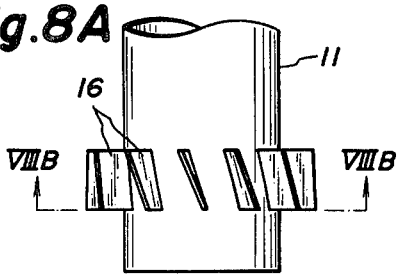
FIG. 8A is a top view of an air whirler.
Figure 8B:
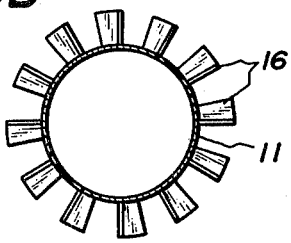
FIG. 8B is a cross-sectional view of FIG. 8A taken along a line VIIIB—VIIIB.
Figure 9A:
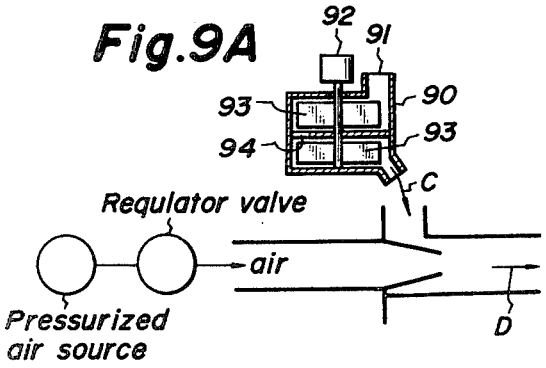
FIG. 9A is a schematic diagram of one example of a source of the mixture of air and pulverized coal.
Figure 9B:
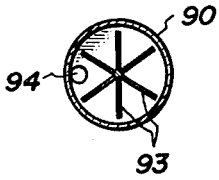
FIG. 9B is a cross-sectional view of a portion of the source shown in FIG. 9A.

As shown in FIGS. 3 and 4, each burner 8 comprises heavy oil supply pipes 10 (in FIG. 4, illustrated by a solid line for simplification) each having a burner tip 9 and surrounded by a protective pipe 11. An air supply pipe having guide pipes 12 on its inner or fore end and supplying air for burning heavy oil in provided to surround the protective pipes 11, and the guide pipes 12 and the air supply pipe 13 are interconnected by a perforated plate 14 provided at the fore end of pipe 13. The intermediate portions of the protective pipes 11 are supported by a supporting plate 26. The heavy oil is atomized by constructing the tips 9 so as to impart a whirling motion to the heavy oil. The burner tip 9 will be detailed later with reference to FIGS. 5 and 6. The perforated plate 14 is provided with a number of perforations having a diameter of several milimeters for example, 3 mm or 6 mm, for passing air through an air whirler having guide blades and the perforated plate 14. The air passing through the perforated plate 14 cools it and prevents it from burning. Furthermore, the air stirs coal flame and heavy oil flame to enhance their mixing. In this embodiment, the burner tip 9, heavy oil supply pipe 10, protective pipe 11, and guide pipe 12 are provided in duplicate. Between the tip of each protective pipe 11 and the tip of each guide pipe 12 is provided an air whirler 15 secured to the protective pipe 11 alone. The whirler 15 comprises, as shown in FIGS. 8A and 8B, a plurality of radial blades 16 which are spaced apart in the circumferential direction and skewed about the axis. Accordingly, the air for burning heavy oil is imparted with a whirling motion when it passes through the whirler 15. The whirling air is well admixed with the heavy oil ejected from the heavy oil burner tip 9 to assist atomization of the heavy oil. Accordingly, the heavy oil flame and the coal flame are efficiently admixed thus improving the combustion. The inlets 10*a* of the heavy oil supply pipes 10 are connected to a source of heavy oil, not shown, and the inlet 13*a* of the air supply pipe 13 is connected to a source of air, not shown. Concentrically with the air supply pipe 13 are provided a coal-air supply pipe 17 which supplies a mixture of pulverized coal and air, a pipe 18 for passing cooling medium, and a caster 19 made of an amorphous fire-proof material for protecting the burner, in the order mentioned. A coal whirler 20 having the same construction as the air whirler 15 shown in FIGS. 8A and 8B is provided between the tips of the air supply pipe 13 and the coal-air supply pipe 17. The whirler 20 imparts a whirling motion to the mixture of air and pulverized coal passing therethrough. The inlet 17*a* of the coal-air supply pipe 17 is connected to such a source of the mixture of air and pulverized coal as shown in FIGS. 9A and 9B.

This source is shown as an arrangement comprising a pressurized air source, a regulator valve and a coal feeder. The regulator valve delivers a desired amount of air into a nozzle pipe in an arrow direction. The coal feeder has a casing 90 which is partitioned into two, upper and lower, chambers. Rotatably mounted concentrically with the casing 90 is a shaft which is driven by a motor 92. The shaft is rigidly mounted with an upper group of blades 93 and a lower group of blades 93, these groups being separated by a partition wall. FIG. 9B shows the group of six blades. When the motor 92 is energized, pulverized coals are fed through an inlet 91 into the upper chamber. As the blades rotate, a desired amount of the pulverized coals confined in a space between adjacent blades are transported toward an opening 94 formed in the partition wall and then, dropped into the lower chamber in which these pulverized coals are conveyed to an outlet so as to be drawn out in the direction shown by an arrow C. Thus, the pulverized coals are admixed with the pressurized air so that a mixture of pulverized coals and air having a desired mixing ratio is delivered in the direction shown by an arrow D.

Figure 7:
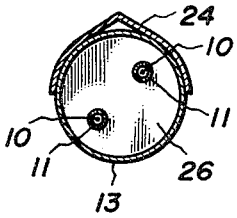
FIG. 7 is a cross-sectional view of FIG. 4 taken along a line VII—VII.

An intermediate whirler 22 is provided between the air supply pipe 13 and the coal-air supply pipe 17 and secured to the air supply pipe 13. Whirler 22 has a construction similar to those of whirlers 15 and 20 and imparts a whirling motion to improve admixing of air and pulverized coal. The whirler 22 cooperates with the coal whirler 20 to make uniform the concentration of the pulverized coal ejected through burner 8 thereby improving combustion of admixed coal and heavy oil. The intermediate whirler 22 also pevents the pulverized coal from depositing on the intermediate portion and then converted into coke by dry distillation. A wear proof arcuate protective cover 24 is provided about the periphery of the air supply pipe 13 at portions facing the inlet of the coal-air supply pipe for preventing the air supply pipe 13 from being damaged by the collision of the pulverized coal. Preferably, as shown in FIG. 7, the protective cover 24, made of a steel material, is so constructed as to have a ridge which acts as if it were a watershed.

As the cooling medium may be used water or air. However, when water is used so that the pipe 18 is constructionally closed at its front end, it leaks through cracks which might be formed in the wall of the pipe 18 so that it is advantageous to use air in which case the tip of the pipe 18 is arranged in concentric with the coal-air supply pipe 17. Cooling air is supplied from a source of cooling air, not shown, into the pipe 18 through an inlet port 18*a*. By cooling the coal-air supply pipe 17 from outside by the cooling medium flowing through pipe 18, the temperature inside of the pipe 17 can be maintained at about 150° C., for example, thereby not only preventing deposition of the pulverized coal onto the inner wall of the pipe 17 but also preventing ignition of the pulverized coal in the burner 8 thus preventing back fire. This also prevents disintegration of the caster due to overheat. When cooling air is used, it is possible to prevent excessive spreading of the mixture of the coal flame and the heavy oil flame, thus assuring efficient combustion.

The protective caster 29 surrounding the cooling medium supply pipe 18 is supported by a plurality of studs secured to the periphery of pipe 18, and a protective ring 27 made of heat resistant cast steel is mounted on the tip of the caster which surrounds the tip of the burner.

The heavy oil supply pipes 10, the protective pipes 11 and the air whirler 15 are mounted to be integral and slidable in the axial direction. By tightening or releasing a bolt 400, the protective pipe 11 together with pipe 10 and whirler 15 is axially moved relative to the air supply pipe 13. The air supply pipe 13, the coal whirler 20 and the guide pipe 12 are also mounted to be integral and slidable in the axial direction. By tightening or releasing a bolt 401, the air supply pipe 13 together with guide pipe 12 and whirler 20 is axially moved relative to the cool-air supply pipe 17. Numerals 400*a* and 401*a* designate bellows. For these axial movements, more steady but complicated arrangement such as for example a rack and pinion mechanism or a piston-cylinder mechanism may be employed. At the commencement of firing, such axial adjustments are carried out to obtain a desired flame condition. In this manner, the combustion condition can be varied as desired by changing the positions of heavy oil ejection and air ejection or by changing the whirling positions of air and of the mixture of pulverized coal and air. In addition, it should be appreciated that the position of burner tip 9 relative to the protective pipe 11 is also responsible for the combustion condition. When the burner tip 9 is flushed with the protective pipe 11, the flame spreads. When the burner tip 9 is recessed relative to the protective pipe 11, the flame becomes thin.

Figure 6:
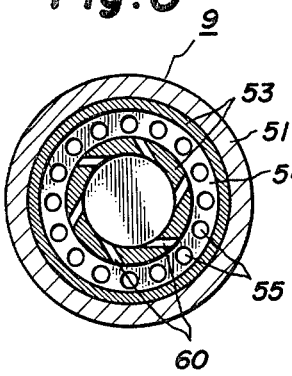
FIG. 6 is an enlarged cross-sectional view of FIG. 5 taken along a line VI—VI.
Figure 5:
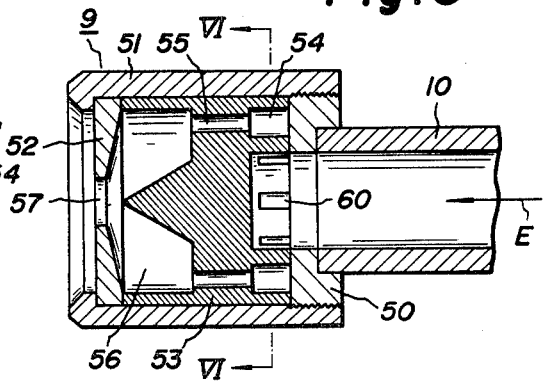
FIG. 5 is an enlarged longitudinal sectional view of a burner tip incorporated in the burner according to the invention.

FIGS. 5 and 6 show one example of a burner tip 9, in the form of a pressurized oil spray type, which is incorporated into the burner of this invention. The burner tip 9 comprises a cylindrical sleeve 51, a front plate 52, a rear plate 50 screwed to the cylindrical sleeve 51, and an internal member 53 having a conical tip which opposes an opening 57 formed in the front plate 52 and formed with an annular recess 54 and a plurality of borings 55. The heavy oil supply pipe 10 is coupled with the rear plate 50. Thus, heavy oil from the heavy oil supply pipe inlet 10*a* connected to a pressurized oil source not shown, is passed in the direction shown by an arrow E into the burner tip 9, directed to the annular recess 54 through a plurality of transverse conduits 60 (See FIG. 6), passed through the longitudinal borings 55 to reach a space 56, and finally ejected through the opening 57.

Where only one burner 8 is used, the direction of whirling of air mixed with heavy oil and of the mixture of pulverized coal and air, that is the direction of twisting the flame may be clockwise or counterclockwise, but when two or more burners are used as shown in FIG. 2, it is advantageous to make different the directions of the air whirler 15 and of the coal whirler 20, for example one in the clockwise direction and the other in the counterclockwise direction, for improving the combustion condition in the kiln.

The pulverized coal may have a size of 200 mesh specified by JIS (Japanese Industrial Standard) or 4900 mesh specified by DIN (Deutch Industrie-Norm) and it is advantageous to use a velocity of 120 m/sec of air ejecting from the air supply pipe 13, and a velocity of 55 m/sec of the coalair mixture ejected from the coal-air supply pipe 17, a velocity of 27 m/sec of the cooling air ejected from the cooling medium supply pipe 18, and a velocity of 50 m/sec of the air ejected from the perforated plate 14.

As above described, according to this invention since heavy oil, air and pulverized coal are ejected concentrically through the same burner for effecting mixed-firing with the heavy oil and coal, the coal flame and the heavy oil flame are thoroughly admixed thereby improving the efficiency of combustion. Accordingly, it is possible not only to make compact the burner but also to eliminate difficulties encountered where coal and heavy oil are burned separately. By the mixed-firing of coal and heavy oil, it is possible to increase the combustion temperature than the burner for exclusive use with coal, thus increasing the efficiency of heat utilization.

When an intermediate whirler is provided for the coalair supply pipe, it is possible to prevent deposition of the pulverized coal and dry distillation of such deposited coal.

According to this invention by varying the ratio of admixed pulvarized coal to heavy oil from 25 to 75% by weight by means of the arrangement such as shown in FIGS. 9A and 9B, it is possible to vary the rate of combustion and heat quantity to any desired values.

Moreover, by effecting mixed firing of C heavy oil containing a relatively large amount of sulfur, e.g. 2 to 3% and pulverized coal containing a relatively small quantity of sulfur, e.g. about 0.3%, it is possible to provide an advantageous effect of using a fuel of low sulfur content, thus decreasing environmental pollution.

It is also possible to use pulverized coke or other combustible substance instead of pulverized coal. Where pulverized plastics are used, the problem of discarded plastics can be readily solved.

What is claimed is:

1. A mixed-firing burner for use with coal and heavy oil comprising a heavy oil supply pipe having a burner tip at one end; a protective pipe surrounding said heavy oil supply pipe; a pipe for supplying air necessary to burn heavy oil and surrounding said protective pipe, said air supply pipe being provided with a guide pipe in its front end; a coal air supply pipe concentrically surrounding said air supply pipe for supplying a mixture of pulverized coal and air; a perforated plate provided at the fore end of said air supply pipe for interconnecting said guide pipe and said air supply pipe, said perforated plate having a great number of perforations formed therin; a cooling medium supply pipe and a protective caster successively surrounding said coal-air supply pipe, said cooling medium supply pipe being supplied with air and having a front end opened to the outside; an air whirler provided between the tip of said protective pipe and said guide pipe; a coal whirler provided between the tip of said air supply pipe and said coal-air supply pipe; and an intermediate whirler located at an intermediate point along the length of said coal-air supply pipe.

2. The burner according to claim 1 wherein said air whirler is secured to the tip of said protective pipe, said coal whirler is secured to the tip of said air supply pipe, and either one or both of said protective pipe and said air supply pipe is slidable in the axial direction.

* * * * *